United States Patent [19]

Pitzen

[11] 4,360,985

[45] Nov. 30, 1982

[54] FIREARMS MAGAZINE SPEED RELEASE LATCH

[76] Inventor: David A. Pitzen, 2324 Chestnut Ct. NE., Cedar Rapids, Iowa 52402

[21] Appl. No.: 185,567

[22] Filed: Sep. 9, 1980

[51] Int. Cl.[3] ..... F41C 25/00

[52] U.S. Cl. ..... 42/6

[58] Field of Search ..... 42/50, 6, 7, 18, 22

[56] References Cited

U.S. PATENT DOCUMENTS 1,397,109 11/1921 Pedersen ..... 42/7
2,338,740 1/1944 Smith ..... 42/18
2,736,977 3/1956 Harvey ..... 42/6
3,574,264 4/1971 Simmons, Sr. ..... 42/6

FOREIGN PATENT DOCUMENTS 8593 5/1894 Switzerland ..... 42/18

*Primary Examiner*—Charles T. Jordan

[57] ABSTRACT

An improved firearms magazine latch mechanism having novel shape permitting the removal of a magazine without the need to manually operate a fingerpiece, but by merely grasping the magazine and pulling downwardly causes the latch mechanism to release the magazine.

1 Claim, 1 Drawing Figure

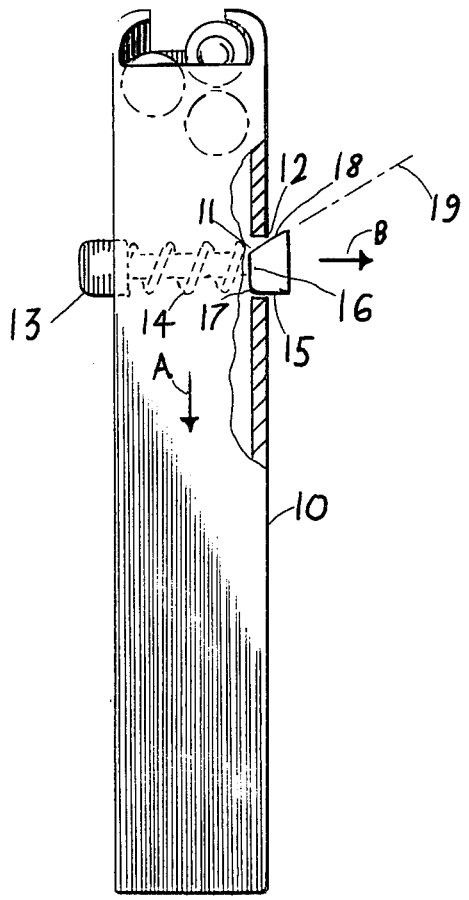
12
18
19
11
B
13
14
17
16
15
A
10

FIREARMS MAGAZINE SPEED RELEASE LATCH

This invention relates to repeating firearms of the type wherein the cartridges are fed from a replaceable box magazine and relates more particularly to an improved latch mechanism for releasably retaining a box magazine within the firearm.

Previously the repeating firearms of the type wherein the cartridges are fed from a replaceable box magazine have been provided with a spring-biased latch mechanism to lock the magazine in place. This has made necessary a manually operated push button or lever to unlatch the magazine and thereby cause some time delay in the replacing of loaded magazines. In a military type situation where time is of the essence, this delay is costly. Also, the manually operated push button or lever now adds unnecessary difficulty in removing the magazine at night when visibility is restricted and during very cold weather when fingers are frozen or gloves are worn. Adding still more difficulty would be the operation of a magazine push button or lever during the extreme tension of battle in a military type situation.

It is therefore an object of this invention to provide repeating firearms with a magazine latch system whereby changing magazines can be easily and rapidly accomplished without the necessity of visually observing the magazine latch members.

It is a further object of this invention to provide a novel magazine latch system that can be easily adapted to existing firearms with little alteration to the original firearm, and allow the use of existing conventional box magazines.

It is a particular object of this invention to provide for the release of a magazine from an automatic firearm without the need to manually manipulate a fingerpiece or lever but now can be easily accomplished merely by grasping and pulling downwardly on the magazine to unlatch the magazine, thereby creating with only minor change to the magazine latch very significant change in the operation of an automatic firearm.

These and other objects and features of the invention will be better understood from the following detailed description, reference being taken to the accompanying drawing.

The drawing shows a typical embodiment of the invention in transverse partly in section view with a conventional box type magazine and an improved magazine retaining latch mechanism in assembled relation to each other.

In the known manner, the magazine 10 is provided with a latch receiving notch 11 into which a nose portion 16 of a latch 15 engages the magazine 10. The magazine latch 15 is biased by a coiled compression spring 14 yieldably pressing the nose portion 16 into the latch receiving notch 11 to hold the magazine 10 in place. Also, in the known manner fingerpiece 13 may be used as an optional method to manually disengage the latch 15 from the magazine 10. And, in the known manner the lower side of the latch nose portion 16 is provided with a cam surface 17 whereby upward movement of the magazine 10 against the cam surface 17 moves the nose portion 16 to the right and disengaged position until such time as receiving notch 11 moves past nose portion 16 whereupon bias of coiled compression spring 14 causes nose portion 16 to engage latch receiving notch 11 in the magazine 10.

Novel change to the nose portion 16 indicated by the numeral 18 and further illustrated by the dash-dot line numbered 19 shows the top of nose portion 16 being bevel cut thereby creating a cam surface 18. The angle of this cam surface 18 and the tension of the coiled compression spring 14 combine to provide a yieldable resistance to the downwardly movement of the magazine 10. When the magazine 10 is drawn downwardly as shown by the arrow A, the bearing surface 12 at the top of the latch receiving notch 11 cams the nose portion 16 as shown by the arrow B in the drawing, causing the nose portion 16 to yieldably move out of engagement with the magazine latch receiving notch 11 thereby unlatching the magazine 10.

It is readily apparent that by grasping the magazine 10 in one hand and pulling downwardly the magazine 10 is releaseable without the need to manipulate the fingerpiece 13.

Although a particular embodiment of the invention has been described in detail herein, it will be readily apparent to those skilled in the art that various changes in form and arrangement of parts may be devised to suit requirements without departing from the spirit and scope of the present invention, and the following claims are intended to include such various changes.

I claim:

1. A mechanism for releasably retaining a box type magazine within a firearm the combination of a notch in a sidewall of said magazine and a transversely slidable magazine latch being provided with a nose portion movable into and out of retaining engagement with said notch and said nose portion normally resiliently pressed into said notch by spring action and a fingerpiece extending for optional manual manipulation to retract said nose portion from said magazine notch wherein the improvement comprises said nose portion being provided with a bevelled top engaging surface to engage the top surface of said notch and said magazine being releasable by applying downward pressure on said magazine and said nose portion being cammed to disengagement position by the action of the top surface of said notch camming the bevelled surface of said nose portion until out of engagement with said magazine notch.

* * * * *